US005472154A

United States Patent [19]

Qiu et al.

[11] Patent Number: 5,472,154

[45] Date of Patent: Dec. 5, 1995

[54] HIGH SPIRAL ANGLE WINDING CORES

[75] Inventors: Yanping Qiu; Terry D. Gerhardt, both of Madison, Wis.; Tony F. Rummage; Clifford A. Bellum, Jr., both of Hartsville, S.C.

[73] Assignee: Sonoco Products Company, Hartsville, S.C.

[21] Appl. No.: 87,599

[22] Filed: Jul. 2, 1993

[51] Int. Cl.[6] ..... B65H 75/10; B31C 3/00

[52] U.S. Cl. ..... 242/609.4; 242/118.320; 156/195; 138/129; 138/144; 493/299

[58] Field of Search ..... 242/609.4, 610, 242/610.1, 610.4, 118.32, 118.7, 118.8; 138/129, 130, 144; 428/34.2, 37; 493/299, 300, 301, 302; 156/195

[56] References Cited

U.S. PATENT DOCUMENTS

| | | | |
|---|---|---|---|
| 2,181,035 | 11/1939 | White | 493/299 |
| 3,194,275 | 7/1965 | Biggs et al. | 138/144 |
| 3,270,778 | 9/1966 | Foll et al. | 138/144 |
| 3,279,333 | 10/1966 | Blair et al. | 493/299 X |
| 3,289,973 | 12/1966 | Spencer | 242/118.32 |
| 3,323,751 | 6/1967 | Cunningham et al. | 242/118.32 |
| 3,362,655 | 1/1968 | Roediger | 242/118.32 |
| 3,429,522 | 2/1969 | Cunningham et al. | 242/118.32 |
| 3,524,779 | 8/1970 | Masters et al. | 493/299 X |
| 3,581,744 | 6/1971 | Voss et al. . | |
| 3,587,656 | 6/1971 | Cummingham et al. | 138/144 |
| 3,778,322 | 12/1973 | Keith et al. | 156/195 |
| 3,810,803 | 5/1974 | Karp et al. | 156/195 |
| 3,826,445 | 7/1974 | Le Hardy | 242/118.32 |
| 4,027,830 | 6/1977 | Dolan | 242/118.32 |
| 4,473,368 | 9/1984 | Meyer | 493/34 |

OTHER PUBLICATIONS

T. D. Gerhardt, "*External Pressure Loading of Spiral Paper Tubes: Theory and Experiment*"; *Journal of Engineering Material and Technology;* Apr. 1990; vol. 112; pp. 144–150.

*Primary Examiner*—John M. Jillions

[57] ABSTRACT

The invention provides spirally wound paperboard cores for winding of textiles and other materials and which have enhanced high speed winding capability. The spirally wound paperboard plies forming the body wall of the paperboard core have a predetermined spiral winding angle with respect to the axis of the cylindrical body wall of greater than 71 degrees. In winding cores having a relatively large ID of between about 4.8 in. (120 mm) and 6 in. (150 mm), the paperboard plies forming the spirally wound cores have a winding angle of greater than 74 degrees. In winding cores having a lower ID of less than 4.8 inches (120 mm), all of the paperboard plies have a width of 3.5 in. (89 mm) or less and a spiral winding angle of greater than 71 degrees.

31 Claims, 4 Drawing Sheets

HIGH SPIRAL ANGLE WINDING CORES

FIELD OF THE INVENTION

The invention is directed to paperboard winding cores for textiles and other materials and which have improved capabilities for withstanding high winding speeds. More specifically, the invention is directed to spirally wound paperboard winding cores having a high spiral winding angle for enhancement of high speed winding of textile filaments and yarns and other materials.

BACKGROUND OF THE INVENTION

Spirally wound paperboard tubes are widely used in textile and other industries as cores for winding of filaments, yarns, and other materials such as films as they are produced. Although paperboard is relatively weak on a single layer basis, a tube constructed from multiple spirally wound paperboard layers can attain substantial strength.

In the textile industry, yarn winding speeds have increased dramatically in recent years. Currently available textile winders are capable of operating at winding speeds of up to 8,000 m/min. High winding speeds result in the application of significant forces to the textile cores as is well known in the art. For example, U.S. Pat. No. 3,980,249 to Cunningham et al., issued in 1976, reported the phenomena of disintegrating and exploding high speed textile cores with winding speeds of 12,000 feet per minute (3660 m/min). The significant increases in textile winding speeds since that time have worsened the known problems.

Winders can be drum driven or spindle driven. Drum driven winders employ a driven winding drum having a drive land which circumferentially contacts the surface of the textile core during start up and rapidly increases the surface speed of the textile core to the desired winding speed. Currently available drum winders are capable of accelerating the speed of the textile core from rest to 6,000 m/min in as little as five seconds. Spindle driven winders accelerate the textile core from rest to the desired winding speed at a much lower rate of acceleration using a driven spindle supported coaxially within the interior of the textile core. These winders include a bail roll having a drive land which contacts the surface of the rotating tube under pressure.

The forces exerted on the textile cores particularly during start up of a high speed winding operation thus include compressive forces (head pressure) such as are exerted by contact between the drive land and the face of the textile core; shear and abrasive forces such as are exerted by the driven winding drum during initial acceleration of the textile core surface; tensile forces resulting from circumferential acceleration from rest to start-up speed; radially oriented stresses resulting from the centrifugal force generated by the high rotational speed of the textile core; and circumferential stresses caused by tube rotation.

Although a few carefully designed and constructed paperboard textile cores have been found capable of operating with the 6,000 meter per minute winders, at the present time no commercially available paperboard textile core is capable of consistently rotating for an excess of two minutes on the 8,000 m/min. winder without exploding. This is true of tubes constructed with the best paperboards in the world.

The mechanisms responsible for disintegration of textile tubes during high speed winder start-up are poorly understood, due in part to the nature of the paperboard tubes, themselves. Paperboard tubes are formed of layers which have been adhered together during the manufacturing process. And the paperboard forming each of these layers is an orthotopic material having properties in the lengthwise or machine direction (MD) that are different from the properties of the same paperboard in the widthwise or cross-machine direction (CD) due to the tendency for more paper fibers to be aligned along the MD as compared to CD. In addition, paperboard strength properties in the direction perpendicular to the plane of the paper are less than those of the paperboard in either the MD or CD, also due to fiber alignment.

Because the paperboard plies forming the textile cores are spirally oriented, there is no alignment of the paperboard plies in either of the CD or the MD directions, along the axis of the tube or along its circumference. Moreover, even though the theoretically predominant stress generated during high speed tube rotation would appear to be the extremely high circumferential stresses at the interior face of the tube, paperboard is known to have sufficient strength to withstand these forces. And observations of exploding tubes reveal failure near the middle of the tube wall.

Recently, a closed-form elasticity solution has been developed to predict stresses and strains in spiral paper tubes loaded axisymmetrically. In experiments to verify this theory, a load was applied via fluid to the exterior periphery of a spirally wound paperboard tube so that the radial load was uniform around the circumference of the tube; see T. D. Gerhardt, "External Pressure Loading of Spiral Paper Tubes: Theory and Experiment", Journal of Engineering Materials and Technology, Vol. 112 , pp. 144– 150, 1990. The theory considered in this work successfully incorporated considerations concerning the orthotopic properties of paperboard tubes. However the dynamic nature of the forces underlying textile core disintegration during high speed winder start-up, and the readily apparent difficulties in replicating these forces under static conditions presents a much more complex set of considerations than those successfully analyzed in the 1990 article.

The angular orientation of spirally wound plies with respect to the tube axis in commercially available textile cores is limited to a relatively narrow range of angles. This is believed to result from manufacturing considerations, the widespread availability of certain standard paperboard ply widths, and the widespread use of textile cores of relatively small standard inside diameters (ID). Currently available textile cores employ spiral winding angle constructions in which the standard ply widths are matched with the desired standard IDs so that known manufacturing efficiencies are increased while manufacturing difficulties are avoided.

Spirally wound tubes are manufactured employing a stationary mandrel. The plies are fed in overlapping relation onto the mandrel and the tube formed on the mandrel is rotated by a belt which moves the tube axially along the mandrel. The angle at which the plies are fed to the mandrel is determined by the outside diameter (OD) of the mandrel and the width of the plies as a result of geometric limitations. Narrower width plies must be fed at a larger winding angle relative to the mandrel (closer to a transverse orientation) while wider plies must be fed at a lower angle (more axially aligned with the mandrel).

The use of wider paperboard plies thus increases the rate of tube formation as a result of different and cumulative effects. Wider plies cover a greater axial length of the mandrel surface simply because they are wider. In addition the lower winding angle that must be used with wider plies provides a closer alignment of the ply with the axis of the mandrel, resulting in a greater axial coverage of the mandrel surface relative to the actual width of the ply. Thus for a given belt speed, the use of wider plies and their corresponding lower wind angles provides a higher tube production rate, i.e., a greater axial length of tube production per minute.

The use of wider plies and their corresponding lower winding angles also simplifies the tube forming process because the plies are fed onto the mandrel in greater alignment with the axial movement of the tube being formed. This in turn, results in a lower friction between the interior surface of the rotating tube and the stationary mandrel. The lower friction between the tube ID and the mandrel can allow for the use of higher belt speeds and can minimize the potential for disruption of adhesion between plies as the tube is rotated around, and moved axially along the mandrel.

With the exception of paperboard tubes of very large IDs, e.g., greater than about one foot, high wind angles are avoided during tube manufacture by the use of wider paperboard plies for the reasons discussed above. With the very large tubes, the large mandrel size dictates the use of high winding angles or the use of extremely wide plies which are not readily available, and which are not readily used with commonly available tube manufacturing equipment. However, standard ID requirements for textile winding cores range from 3 in. (75 mm) up to 5.6 in. (143 mm). Tubes of these IDs can be, and are, manufactured without requiring use of high winding angles and narrow ply widths. Thus, all commercially available textile cores for high speed winders are made using continuous plies having widths of 4 inches or greater and winding angles of less than 74 degrees. Textile cores having diameters in the lower portion of the standard range have winding angles of less than 70 degrees. Textile cores having diameters in the upper part of the standard range use ply widths of at least 5 inches.

SUMMARY OF THE INVENTION

The invention provides spirally wound paperboard winding cores of enhanced high speed winding capability for winding of textile filaments and yarns and other materials such as films. In accordance with the invention, it has been found that increasing the spiral winding angle of paperboard plies in winding cores reduces detrimental stresses in the tube wall caused by high speed rotation. In addition, it has been found that higher spiral angles can also reduce the stresses from compressive forces exerted on the face of winding cores by drive lands.

The spirally wound paperboard winding cores of the invention are defined by a cylindrical body wall having a plurality of structural layers formed from spirally wound paperboard plies, each of which form a predetermined spiral winding angle with the axis of the cylindrical body wall of greater than 71 degrees. In winding cores having a relatively large ID of between about 4.8 in. (120 mm) and 6 in. (150 mm), the paperboard plies forming the spirally wound paperboard winding cores form a winding angle of greater than 74 degrees. Paperboard plies having effective widths of less than 4.5 in. (115 mm) are used to form these winding cores. In winding cores of the invention having lower IDs, i.e., less than 4.8 inches (120 mm), all of the paperboard plies forming the core have a width of about 3.5 in. (89 mm) or less and have a spiral winding angle of greater than 71 degrees.

Spiral winding angles above 74 degrees and paperboard plies of widths less than 3.5 in. have not been previously used commercially to produce textile winding cores due, at least in part, to increased costs resulting from slower production speeds and increased difficulties in fabricating the cores. Nevertheless, it has been found in accordance with the invention that performance of high speed textile cores is significantly improved by increasing spiral angle. Moreover, the performance improvement will occur with substantially any type of paperboard.

Although the causes behind delamination and explosion of textile cores at high winding speeds, particularly during start up, are still not fully understood or eliminated, it has been found that increasing the spiral wind angle helps reduce stresses for at least two of the detrimental loading conditions present in high speed winding. Achieving a greater alignment between the paperboard plies and the circumference of the paperboard tube increases the circumferential bending stiffness of the tube which decreases the detrimental effects caused by compressive load forces applied radially inwardly on the surface of the tube by the land or winding drum of the high speed winders. Moreover, it has been found that free spinning stresses within the tube wall resulting from high speed rotation are also reduced by increasing the spiral winding angle of the plies.

The improved textile core constructions of the invention provide capabilities for improving high-speed winding performance of textile cores without requiring modifications to the paperboard, glue, textile core surface, and/or other core components such as have been typically modified in the past for improving high speed winding performance. In preferred embodiments, the invention has been demonstrated to be capable of dramatically improving performance of high speed textile cores subjected to winder speeds of 8,000 meters per minute for two minutes. Although nearly 50 percent of conventionally constructed cores could not survive these conditions for two minutes, nearly all of the preferred cores of this invention did survive these conditions for at least two minutes. This has been accomplished by changing winding angle from 73 to 81 degrees and without changing any other parameter of the tube construction. The invention is also applicable to substantially improve the performance of textile cores used at lower winding speed operations, for example, winding speeds of 6,000 meters per minute. The invention is applicable to textile winding cores of different constructions, wall thicknesses, multi-component walls and the like and is believed capable of improving performance on high speed winders in each case. Thus, textile winding core constructions of the invention can be employed in combination with numerous other textile core construction improvements to provide the textile cores of greatly improved high speed winder performance. The winding cores of the invention can improve the efficiency and reliability of high speed winding operations for textile yarns (including continuous filament yarns and yarns formed of staple fibers) because tube explosion and disintegration problems are minimized.

DESCRIPTION OF THE DRAWINGS

In the drawings which form a portion of the original disclosure of the invention.

DETAILED DESCRIPTION OF THE PREFERRED EMBODIMENT

Figure 1:
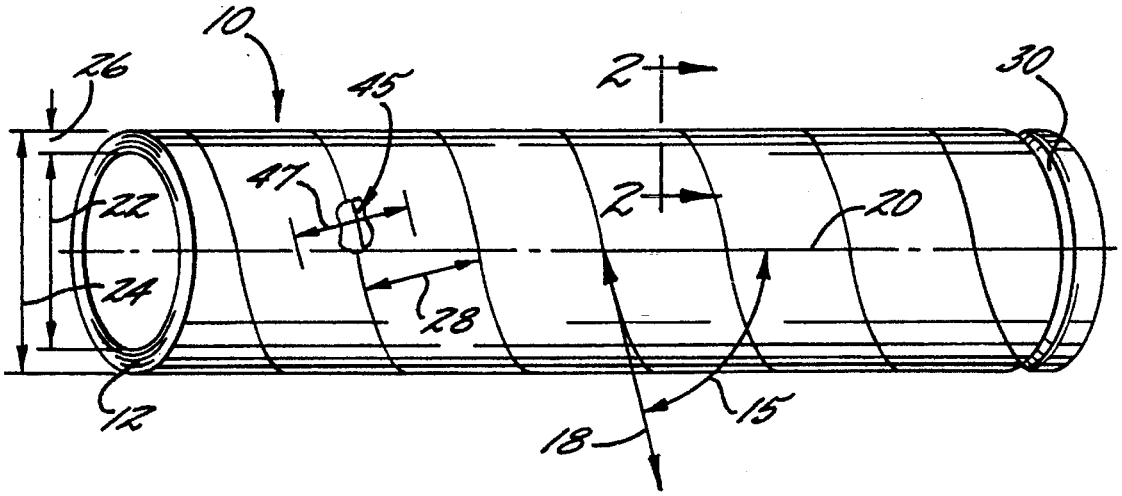
FIG. 1 is a perspective view of one preferred textile winding core construction of the invention.

Various constructions and embodiments according to the invention are set forth below. While the invention is believed best understood with reference to specific constructions, processes and apparatus, including those illustrated in the drawings, it will be understood that the invention is not intended to be so limited. To the contrary, the invention includes numerous alternatives, modifications and equivalents as will become apparent from a consideration of the foregoing discussion and the following detailed description.

FIG. 1 illustrates a spirally wound paperboard tube 10 formed of a cylindrical body wall 12 in accordance with the invention. The cylindrical body wall 12 is formed of a plurality of plies of paperboard having a spiral winding angle 15 which is determined by the direction of wind 18 of the paperboard plies relative to the longitudinal axis 20 of the tube 10. As indicated previously and discussed in greater detail below, the spiral winding angle for paperboard tubes of the invention is greater than 71 degrees and is preferably greater than 74 degrees.

As also shown in FIG. 1, the tube 10 has a predetermined inside diameter 24 and a predetermined outside diameter 24 which, together, define a predetermined wall thickness 26. The paperboard plies forming tube 10 have a width 28 which, taken together with the inside diameter 22 of the tube, determine the spiral winding angle 15 of the tube as discussed in greater detail later.

As illustrated in FIG. 1, textile winding cores typically include a start-up groove 30 or a similar means useful in initiating start-up of a continuous filament or thread wound onto the core at high speed. As is well known to those skilled in the art, the start-up groove 30 provides a mechanism for gripping the start-up end of a thread or yarn which comes into contact with the groove 30 due to the action of an operator or an automatic mechanism in a conventional winder. Because of standards and uniformity considerations in the textile industry, equipment for winding and unwinding of yarns and threads is generally constructed to support a textile core having an inside diameter 22 of greater than about 2.8 inches (70 mm) up to less than about 6 inches (150 mm). For high speed performance, the textile cores 10 are typically limited to wall thicknesses of less than about 0.40 in. (10.2 mm).

Figure 2:
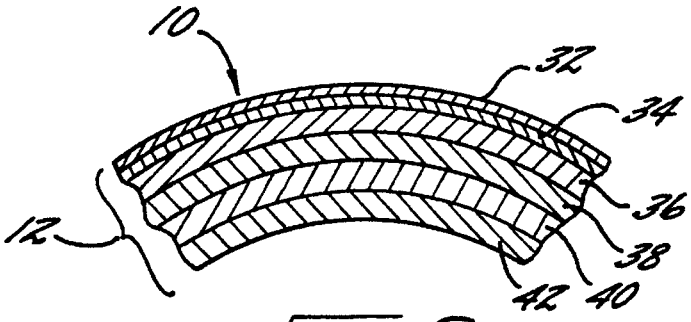
FIG. 2 schematically illustrates a partial cross-sectional view taken along line 2—2 of FIG. 1 for illustrating various layer constructions and arrangements in the walls of textile cores according to the invention.

FIG. 2 illustrates a partial cross-sectional view of a textile core which includes a surface layer 32 and a plurality of structural layers 34, 36, 38, 40 and 42. It will be apparent to the skilled artisan that the number of layers illustrated in FIG. 2 is far fewer than the typical number of layers in a textile core for the sake of illustration and convenience.

Typically in a textile core, a very thin non-structural surface layer such as layer 32 is provided in order to impart certain surface finish, texture and/or color characteristics to the surface of the textile core. Normally, a paper material such as a parchment paper is used to form surface layer 32. It is also conventional to employ a surface layer 32 wherein the edges of the ply are overlapped a small amount as indicated generally at 45 in FIG. 1. In such cases, the center-to-center width of the paperboard ply, 47 in FIG. 1 defines the effective width of the paperboard ply.

In addition, textile cores can also include one or a plurality of functional layers 34, typically near the surface of the core which may be provided in order to perform specific functions such as improving the smoothness of the core surface by providing deckled overlapped edges such as disclosed in U.S. Pat. No. 3,980,249. The functional layers 34 provided at or near the surface of the core can also achieve other functions such as improving shear resistance, abrasion resistance, improving smoothness at non-overlapping surfaces, etc. Such functional layers are for the purpose of this invention also considered to be structural layers.

The paperboard plies forming the body wall 12 typically have thicknesses within the range of between about 0.003 in. and about 0.035 in. Generally, the main or structural plies forming the body wall, i.e., plies 34, 36, 38, 40 and 42 have a wall thickness within the range of between about 0.012 in. and about 0.035 in. The densities of the plies employed in forming the textile cores 10 can also be widely varied, typically within the range of from about 0.50 to 0.90 g/cm$^3$ and more typically within the range of from about 0.55 to about 0.85 g/cm$^3$. Normally, at least a portion of the paperboard plies forming the body wall of a textile core will have a density within the upper portion of these ranges because of the strength requirements for the walls of textile cores.

Figure 3:
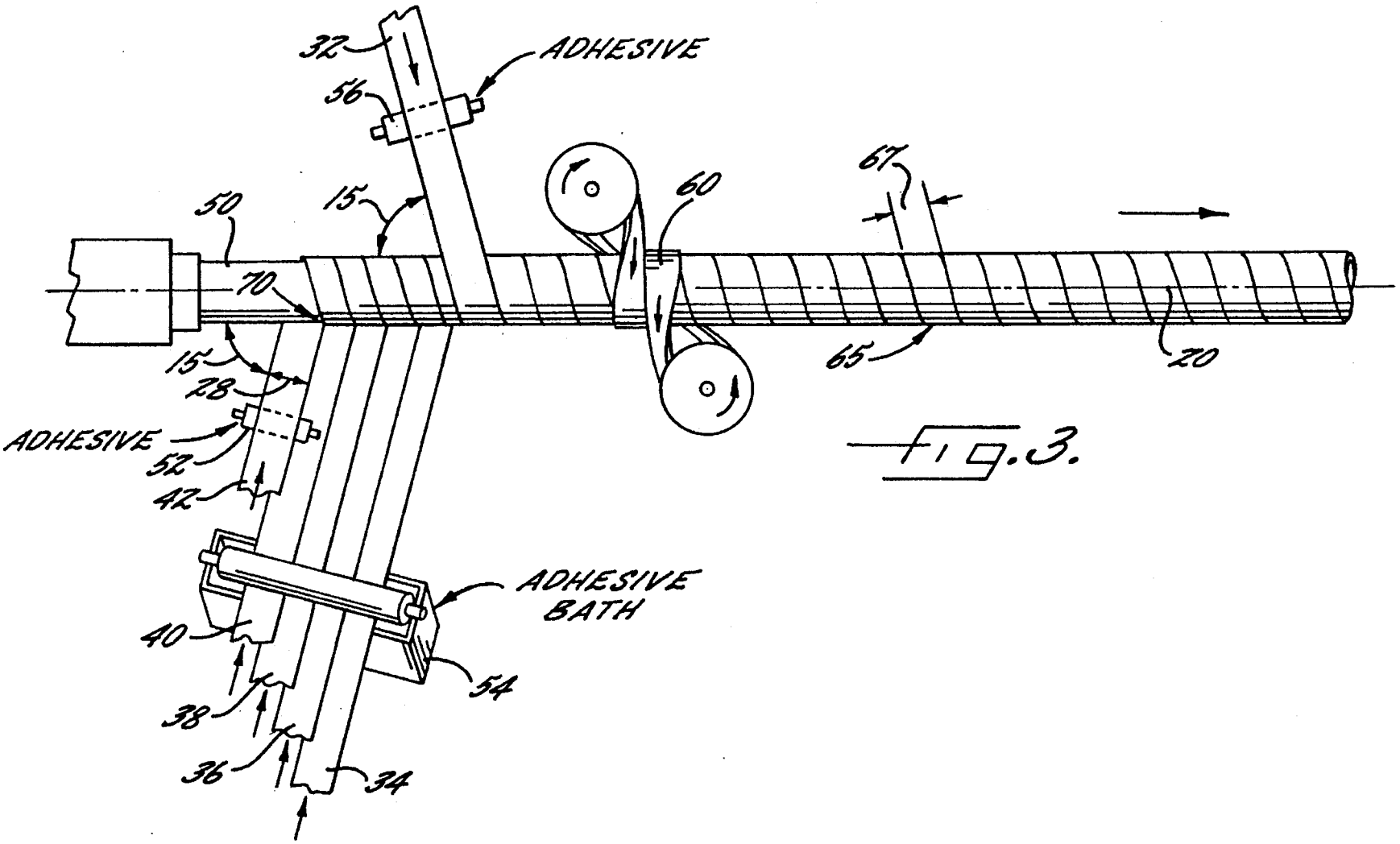
FIG. 3 illustrates one preferred process and apparatus for forming textile winding cores according to the invention.

FIG. 3 schematically illustrates one preferred process of forming high spiral angle textile cores in accordance with the invention. In FIG. 3, the innermost paperboard ply 42 is supplied from a source (not shown) for wrapping about a stationery mandrel 50. Prior to contacting the mandrel 50, the paperboard ply 42 is treated on its exterior face with a conventional adhesive from adhesive supply 52. The next paperboard layer 40 is thereafter wound onto layer 42 and is typically treated so that adhesive material will be present on both of its exterior and interior faces once it is formed into a tube. This may be accomplished by immersion in an adhesive bath 54, by roller coating, or by a metering adhesive coating process as is known in the art.

Layers 38, 36 and 34, respectively, are wound in overlapping relation on to the first two layers in order to build up the structure of the paperboard wall. As with ply 40, each of plies 38, 36 and 34 are immersed in an adhesive bath 54 or are otherwise coated with an adhesive prior to winding onto mandrel 50. A surface ply 32 is thereafter coated on its interior surface via an adhesive supply 56 and is wound on top of layer 34.

The multiple layer paperboard tube thus formed is rotated by one or more rotating belts 60 which rotate the entire multiple ply structure 65 on mandrel 50 and moves the tube axially along the mandrel in the direction of orientation of the plies relative to the mandrel. The continuous tube 65 is cut into individual tube lengths by a rotating saw or blade (not shown) as will be apparent to those skilled in the art. Typically, when the paperboard tube is intended for use as a textile core, the tube length will be within the range of between about six inches and 15 inches. Winding cores for high speed winding of film and paper according to the invention can have lengths up to about 40 inches and diameters up to 6 inches.

As indicated in FIG. 3, each of the plies are wound onto the mandrel 50 or onto the underlying ply at a predetermined winding angle 15 which is substantially the same for each of the plies. The angle 15 is determined by the diameter of mandrel 50 and the width 28 of the paperboard ply. Thus, as is known to those skilled in the art, for a given ply width 28 and a given diameter of a mandrel 50, there is only one angle 15 which allows the ply to be wound around the mandrel such that the opposed edges of the ply, mate in surface-to-surface contact to form a butt joint as indicated at area 70 in FIG. 3. Because the angle 15 is determined by the width of the ply and diameter of the supporting surface, there can be a slight difference between the width and/or winding angle of the innermost ply 42 of a tube and the outermost ply 32 thereof as will be apparent. Typically because of the wall thickness ranges used in textile cores, the effective ply width will vary no more than about 0.10 inches.

For other winding cores, a greater wall thickness range can be used and in such cases, ply thickness and/or winding angle can vary between the interior plies and the exterior plies to a greater extent. For winding cores having a wall thickness greater than 0.40 in. (10.2 mm), winding angle and effective ply width are expressed as the mean average based on all of the plies.

As will be apparent from a consideration of the process and apparatus illustrated in FIG. 3, the rate that the paperboard tube 65 is formed and moved to the right on mandrel 50 will be dependent on the rate of speed of winder belt 60 and upon the width 28 of the paperboard plies such as ply 42. Thus, the belt 60 will determine the rate at which the tube 65 is rotated. For each rotation of the tube, the tube will move axially in an amount determined by the dimension 67 of each ply measured along the axis 20 of the tube. As will be apparent, dimension 67 is directly proportional to the width of the ply, but is inversely proportional to the sine of the wind angle thereof. Thus, narrower plies must be applied to a mandrel at a higher spiral winding angle and result in the formation of paperboard tubes at slower rates.

In addition, the use of narrow plies and high winding angles in accordance with the present invention results in an increased circumferential orientation and increased gripping of the mandrel by the plies used to form the textile core. This increased gripping of the mandrel by the plies results in greater friction between the tube and the mandrel, and therefore typically requires that the belt 60 be driven at a lower rate than with wider plies in order that this friction be minimized as the tube 65 travels down the mandrel 50. The increased friction can also cause nonuniform adhesion between plies. However, it has been found that in order to minimize such friction, a modified mandrel can be employed for tube formation such that the outside diameter of the mandrel is decreased slightly, e.g., at a rate of about 0.004 in. per linear foot of mandrel 50 in the direction of tube movement. The decrease in mandrel diameter can be continuous or in discrete segments.

Because of the decrease in production speeds and the increased difficulty in producing spirally wound tube with high wind angles, textile cores have, in the past, been formed with plies having widths of 4 inches or greater. Dimensions for known textile cores are set forth in Table 1 below.

TABLE 1

| Inside Diameter inches (mm) | Ply Width inches (mm) | Spiral Angle Degrees |
|---|---|---|
| 5.63 (143) | 5.0 (127) | 73.6 |
| 4.92 (125) | 5.0 (127) | 71.1 |
| 4.72 (120) | 5.0 (127) | 70.3 |

TABLE 1-continued

| Inside Diameter inches (mm) | Ply Width inches (mm) | Spiral Angle Degrees |
|---|---|---|
| 4.33 (110) | 5.0 (127) | 68.4 |
| 4.33 (110) | 4.0 (102) | 72.9 |
| 3.78 (94) | 5.0 (127) | 64.5 |
| 3.78 (94) | 4.0 (102) | 69.9 |
| 2.95 (75) | 5.0 (127) | 57.4 |
| 2.95 (75) | 4.0 (102) | 64.5 |

It will be apparent from a review of the above that textile cores have never previously been formed with paperboard plies having widths significantly less than 4.0 inches. It will also be apparent that textile cores have not heretofore been formed with wind angles greater than 74 degrees.

Figure 4:
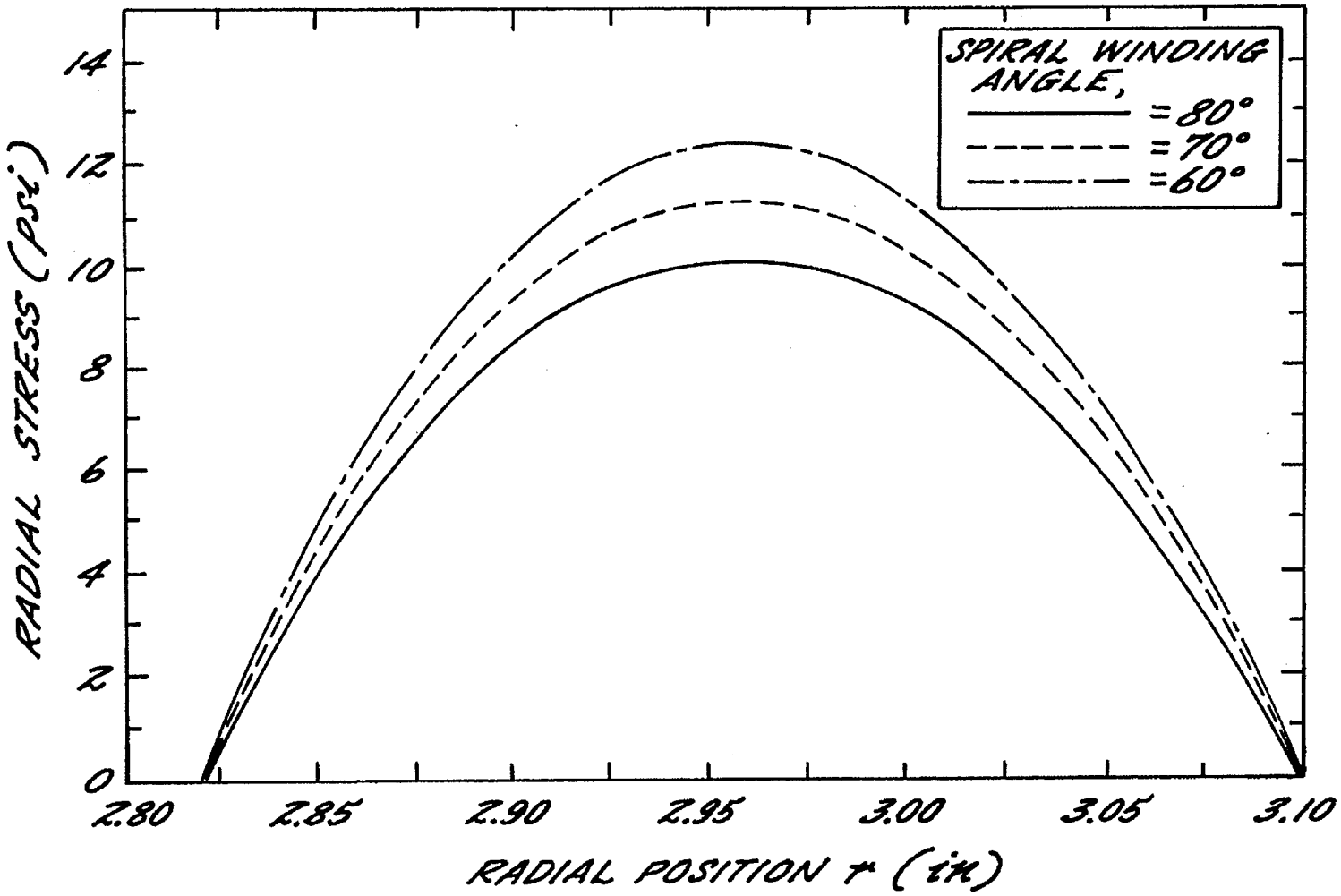
FIG. 4 is a graph illustrating the influence on free spinning radial stress within the wall of a textile core as a result of varying spiral winding angles of 60 degrees, 70 degrees and 80 degrees.

FIG. 4 illustrates the beneficial effect of increasing winding angle on tensile stresses theoretically generated during high speed rotation of textile cores. Computer simulations of tube rotation at a surface speed of 8000 m/min. were designed and performed on theoretical textile tubes having an inside diameter of approximately 5.64 inches, a wall thickness of approximately 0.28 inch and a spiral winding angle of 60, 70 or 80 degrees. The radial stress at each position within the tube wall was calculated by extending the analysis described in the previously mentioned April 1990 publication: Gerhardt, External Pressure Loading of Spiral Paper Tubes: Theory and Experiment. The considerations involved in 1990 work were in part extended using principles of rotational physics discussed in: Genta, G. Gola, M., The Stress Distribution in Orthotopic Rotating Discs, Journal of Applied Mechanics, vol. 48, pp. 559–562 (1981); however, the stress relationship illustrated in FIG. 4 is not described in either of the above publications. Significantly, the tensile stress calculations illustrated in FIG. 4 were complicated by the anisotropic nature of paper tubes and, in that the direction of radial stress is perpendicular both to the orientation of paper in tubes and in that the direction of the radial stress is perpendicular to the plane of the spiral angle change.

As illustrated in FIG. 4, these calculations suggested that radial stress caused by tube rotation is greatest near the center of the tube wall. Moreover, as illustrated in FIG. 4, these calculations suggested that the value of radial stress changes considerably when the spiral angle or wind angle is decreased in spirally wound paperboard tubes.

Subsequently, a series of paperboard tubes were prepared and subjected to testing on an 8,000 m/min winder commercially available from TORAY LTD., a well-known winder manufacturer. The tubes were constructed with an inside diameter of 5.64 inches and wall thicknesses of 0.260 inches. The spiral winding angles for the paperboard tubes were varied from 73.2 degrees up to 80.0 degrees. The tubes were constructed from a very high strength paperboard of Sonoco Products Company, having a density of 0.749 g/cm$^3$and a ring crush of 4200 psi which is comparable to very high strength paperboards available from other vendors, e.g., Ahlstrom (Finland) paperboard V-600, Enso (Finland) paperboard Pori 1000, and the like.

Figure 5:
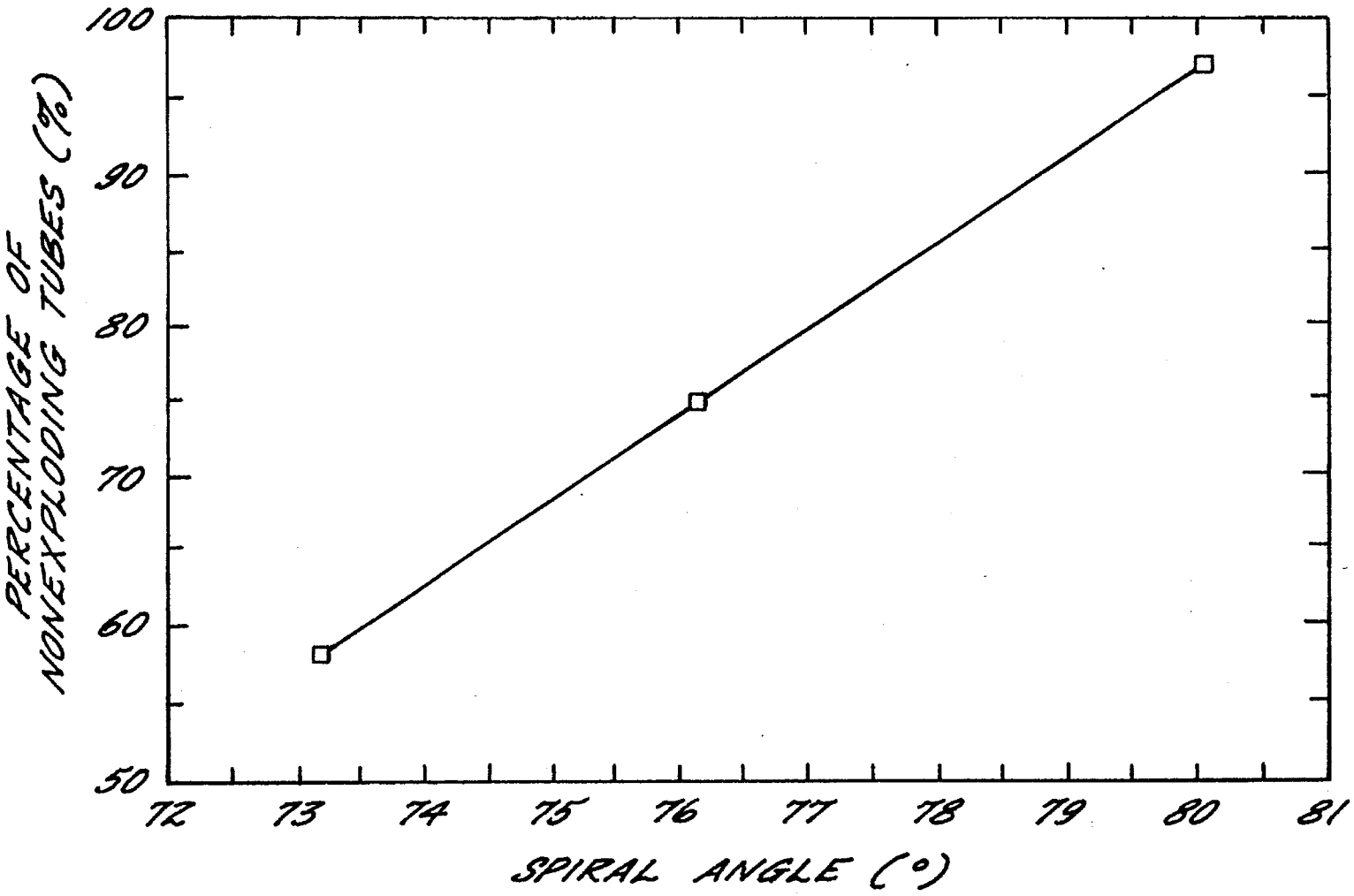
FIG. 5 is a graph illustrating performance of the textile cores having wind angles varying from 74 to 81 degrees on high speed winders rotating at speeds of 8,000 meters per minute, for a period of two minutes.

The results of tests on these cores are shown in FIG. 5 which graphically displays the percentage of tubes which could be rotated without exploding for a period of at least two minutes, at 8,000 meters per minute and while the drive land of the winder was maintained in contact with the face of the paperboard tube being rotated. As shown in FIG. 5, the percentage of non-exploding tubes increased dramatically, from 58 percent to 97 percent, as the spiral winding angle was increased from 73.2 degrees to 81 degrees.

It will be apparent from a review of FIG. 5 that changing the spiral winding angle creates a significant difference in tube performance. Moreover, when the winder used to produce the results shown in FIG. 5 is operated at a lower speed, for example at a winding speed of 7000 m/min. or greater, the results shown are improved significantly.

Another set of spirally wound paperboard cores were constructed in accordance with the invention for use with 6,000 meter per minute winders of the type using a drive roll which circumferentially contacts the textile core via the drive land. In this case, the cores were constructed with an inside diameter of 75 mm and wall thickness of 6 mm. The textile cores had a multi-grade wall thickness construction which was identical in all cores. The interior tube plies constituting about 45 percent of the total wall thickness of the tube were made from paperboard commercially available as Lhomme Superior (commercially available from Lhomme, a French Company); a portion of the paperboard wall constituting 37 percent of the wall thickness adjacent and radially exterior to the previous portion was composed of Lhomme Extra (also available from Lhomme, France), a higher strength paperboard; the remaining 17 percent of the wall thickness was constructed from GASCONGE Kraft (commercially available from Papeteries Gasconge, France) for surface smoothness.

One set of cores was constructed from plies having an effective width of four inches. These cores had a spiral winding angle of 64.5 degrees. A second set of identical cores were constructed having a spiral winding angle of 71.1 degrees (this is a high winding angle for cores of 75 mm inside diameter) and the plies used to form the second set of cores had a width of three inches.

The cores constructed from four inch wide paperboard plies did not perform acceptably on a Barmag winder at 6,000 meters per minute with 42 pounds of head pressure applied to the cores by the winding drum. However, the cores having a spiral winding angle of 71 degrees and prepared from three inch wide paperboard plies performed extremely well in the test such that out of 40 cores tested, 39 performed perfectly over a test duration of two minutes. One of the 40 cores exhibited a small amount of peeling between layers due to insufficient adhesive application during manufacture. Even this core did not explode.

Preferred paperboard textile cores prepared in accordance with the invention have the following constructions:

TABLE 2

| Inside Diameter inches (mm) | Ply Width inches (mm) | Spiral Angle Degrees |
|---|---|---|
| 5.63 (143) | 4.0 (102) | 76.9 |
| 5.63 (143) | 3.0 (76) | 80.2 |
| 4.92 (125) | 4.0 (102) | 75.0 |
| 4.92 (125) | 3.0 (76) | 78.8 |
| 4.72 (120) | 4.0 (102) | 74.4 |
| 4.72 (120) | 3.0 (76) | 78.3 |
| 4.33 (110) | 3.0 (76) | 77.3 |
| 3.78 (94) | 3.0 (76) | 75.0 |
| 2.95 (75) | 3.0 (76) | 71.1 |

The above preferred tube constructions are based on readily available plies of standard width. However, it will be apparent that the invention can be employed in connection with plies of non-standard widths. Thus, for textile cores having a relatively large inside diameter of at least 4.8 in. (120 mm), plies having an effective width of less than 5 in. (127 mm), preferably less than about 4.5 in. (115 mm) are used to prepare tubes having wind angles of at least about 74 degrees. For textile cores having diameters less than 4.8 in. (120mm) paperboard plies having an effective width of less than 4 in. (103 mm), preferably less than about 3.5 in. (89 mm) are employed to provide spirally wound textile cores having wind angles of about 71 degrees or greater.

There are numerous variations which can be employed in manufacturing textile cores according to the invention, including variations in adhesives, tube wall thickness, paper grades, paper ply thicknesses, etc. In general, those skilled in the art will recognize that some degree of experimentation is often necessary in order to determine appropriate adhesives, paperboard grades, paperboard thicknesses, tube wall thicknesses and the like. Nevertheless, it is believed that increasing the spiral winding angle of all such spirally wound textile cores as per this invention will substantially improve the high speed winding performance of the textile core.

In the foregoing, the high spiral angle winding cores of the invention have been discussed primarily with reference to textile winding cores, which constitute preferred embodiments of the invention. However the invention is applicable to high speed winding of other materials such as strip material, films, paper and the like. As indicated previously, such winding cores have an ID of 6.0 in. (152 mm) or less and a length of less than about 40 in. (102 cm).

The invention has been described in considerable detail with reference to preferred embodiments. However, many changes, variations and modifications can be made without departing from the spirit and scope of the invention as described in the foregoing detailed specification and defined in the appended claims.

That which is claimed:

1. A spirally wound paperboard winding core for textiles or other materials and having enhanced high speed winder capability comprising:

a cylindrical body wall having a predetermined inside diameter of less than about 6 inches and a predetermined wall thickness and being oriented along a central axis, said body wall being formed from a plurality of structural spirally wound paperboard plies, each of said plies having a predetermined effective width and forming a predetermined spiral winding angle with respect to said central axis;

wherein said spiral winding angle is at least about 71 degrees and wherein the effective width of said paperboard plies is less than about 3.5 inches.

2. The spirally wound paperboard winding core of claim 1 wherein the predetermined inside diameter of said tube is at least about 2.8 inches and the winding core is a textile winding core.

3. The spirally wound paperboard winding core of claim 2 wherein the inside diameter of said winding core is at least about 2.95 inches.

4. The spirally wound paperboard winding core of claim 3 wherein the wall thickness of said cylindrical body wall is less than about 0.40 inches.

5. The spirally wound paperboard winding core of claim 1 wherein the effective width of said paperboard plies is about three inches or less.

6. The spirally wound paperboard winding core of claim 5 wherein said winding core is a textile winding core.

7. A spirally wound paperboard winding core for winding of textiles or other materials and having enhanced high speed winder capability comprising:

a cylindrical body wall having a predetermined inside diameter of less than about 6 inches and a predetermined wall thickness and being oriented along a central longitudinal axis, said cylindrical body wall being formed of a plurality of structural spirally wound paperboard plies, each of said plies forming a predetermined spiral winding angle of greater than 74 degrees with respect to said central longitudinal axis of said cylindrical body wall and having a predetermined effective width of less than 5 inches.

8. The spirally wound paperboard winding core of claim 7 wherein said effective width of said paperboard plies is less than about 4.5 inches, said predetermined winding angle is greater than about 75 degrees, and said winding core is a textile winding core.

9. The spirally wound paperboard winding core of claim 7 wherein the effective width of said paperboard plies is less than about 4.25 inches.

10. The spirally wound paperboard winding core of claim 7 wherein the effective width of said paperboard plies is less than about 3.5 inches.

11. The spirally wound paperboard winding core of claim 7 wherein the effective width of said paperboard plies is about 3 inches or less.

12. The spirally wound paperboard winding core of claim 9 wherein the inside diameter of said cylindrical body wall is greater than about 2.8 inches.

13. The spirally wound paperboard textile core of claim 12 wherein said winding core is a textile winding core.

14. The process for forming a spirally wound paperboard winding core comprising the steps:

applying adhesive to a plurality of continuous paperboard plies of predetermined width and spirally winding said continuous paperboard plies around a stationary mandrel of predetermined exterior diameter of less than about 6 inches in overlapping relation at a predetermined spiral winding angle to thereby form a continuous paperboard tube advancing axially along said mandrel;

wherein each of said paperboard plies are wound onto said mandrel at a predetermined spiral winding angle of greater than about 75 degrees and form an effective width thereon of less than about 4.5 inches.

15. The process of claim 14 wherein at least a portion of said stationary mandrel comprises a diameter which tapers to a smaller diameter in the direction of axial advancement of said paperboard tube along said mandrel.

16. The process of claim 14 wherein said effective width of said paperboard plies is about 4 inches or less.

17. The process of claim 14 wherein the effective width of said paperboard plies is less than about 3.5 inches.

18. The process of claim 14 wherein the outside diameter of said mandrel is greater than about 2.8 inches.

19. The process of claim 14 further including the steps of forming a plurality of individual tubes by cutting said continuous tube into unit lengths of less than about 15 inches and forming a start-up groove on a portion of the periphery of each of said tubes adjacent at least one end thereof.

20. The process for forming a spirally wound paperboard winding core comprising the steps:

applying adhesive to a plurality of continuous paperboard plies of predetermined width and spirally winding said continuous paperboard plies around a stationary mandrel of predetermined exterior diameter less than about 6 inches in overlapping relation at a predetermined spiral winding angle to thereby form a continuous paperboard tube advancing axially along said mandrel;

wherein each of said paperboard plies are wound onto said mandrel at a predetermined spiral winding angle of greater than about 71 degrees and form an effective width thereon of less than about 3.5 inches.

21. The process of claim 20 wherein at least a portion of said stationary mandrel comprises a diameter which tapers to a smaller diameter in the direction of axial advancement of said paperboard tube along said mandrel.

22. The process of claim 20 wherein the outside diameter of said mandrel is greater than about 2.8 inches.

23. The process of claim 20 further including the steps of forming a plurality of individual tubes by cutting said continuous tube into unit lengths of less than about 15 inches and forming a start-up groove on a portion of the periphery of each of said tribes adjacent at least one end thereof.

24. An improved high speed yarn winding process for textile yarns comprising the steps:

supporting on the spindle of a high speed winder a textile winding core comprising a cylindrical body wall having a predetermined inside diameter of less than about 6 inches and a predetermined wall thickness and being oriented along a central axis, said body wall being formed from a plurality of structural spirally wound paperboard plies, each of said plies having a predetermined effective width of less than about 3.5 inches and forming a predetermined spiral winding angle of greater than about 71 degrees with respect to said central axis;

rotating said textile winding core at a predetermined circumferential speed of at least about 6000 meters per minute; and winding a continuous yarn onto said rotating core at a speed the same as or greater than said predetermined circumferential speed.

25. The high speed winding process of claim 24 wherein the wall thickness of said cylindrical, body wall of said textile winding core is less than about 0.40 inches.

26. The high speed winding process of claim 25 wherein the effective width of said paperboard plies of said textile winding core is about three inches or less.

27. The high speed winding process of claim 24 wherein said predetermined circumferential speed is greater than about 7000 meters per minute.

28. An improved high speed winding process for textile yarns comprising the steps:

supporting on the spindle of a high speed winder a textile winding core comprising a cylindrical body wall having a predetermined inside diameter of less than about 6 inches and a predetermined wall thickness and being oriented along a central axis, said body wall being formed from a plurality of structural spirally wound paperboard plies, each of said plies having a predetermined effective width of less than about 5 inches and forming a predetermined spiral winding angle of greater than 74 degrees with respect to said central axis;

rotating said textile winding core at a predetermined circumferential speed of at least about 6000 meters per minute; and winding a continuous yarn onto said rotating core at a speed the same as or greater than said predetermined circumferential speed.

29. The high speed winding process of claim 28 wherein the wall thickness of said cylindrical body wall of said textile winding core is less than about 0.40 inches.

30. The high speed winding process of claim 29 wherein the effective width of said paperboard plies of said textile winding core is about 4.5 inches or less and said predetermined winding angle is at least about 75 degrees.

31. The high speed winding process of claim 30 wherein said predetermined circumferential speed is greater than about 7000 meters per minute.

* * * * *

UNITED STATES PATENT AND TRADEMARK OFFICE

CERTIFICATE OF CORRECTION

PATENT NO. : 5,472,154

DATED : December 5, 1995

INVENTOR(S) : Qiu et al.

It is certified that error appears in the above-identified patent and that said Letters Patent is hereby corrected as shown below:

Column 5, line 35, "24" (first occurrence) should be -- 22 --.

IN THE CLAIMS:

Column 12, line 9, "tribes" should be -- tubes --.

Signed and Sealed this

Twenty-seventh Day of February, 1996

*Attest:*

Bruce Lehman

BRUCE LEHMAN

*Attesting Officer*

*Commissioner of Patents and Trademarks*